US005168644A

United States Patent [19]

Ellis

[11] Patent Number: 5,168,644

[45] Date of Patent: Dec. 8, 1992

[54] MOTORCYCLE BOOT WEAR PROTECTION DEVICE

[76] Inventor: Keith Ellis, 6608 Allen La., Columbia, Md. 21045

[21] Appl. No.: 734,744

[22] Filed: Jul. 23, 1991

[51] Int. Cl.[5] ..... A43B 13/22; A43B 5/00

[52] U.S. Cl. ..... 36/72 R; 36/132

[58] Field of Search ..... 36/72 R, 72 A, 136, 36/132

[56] References Cited

U.S. PATENT DOCUMENTS

| | | | |
|---|---|---|---|
| 690,003 | 12/1901 | Altman | 36/72 R |
| 2,814,887 | 12/1957 | Hockley | 36/72 R |
| 2,851,798 | 9/1958 | Phillips | 36/72 R |
| 3,241,153 | 3/1966 | Brewer | 36/72 R |
| 3,486,250 | 12/1969 | Purtle | 36/72 R |
| 3,747,239 | 7/1973 | Green | 36/72 R |
| 3,995,382 | 12/1976 | Smith | 36/72 R |
| 4,722,477 | 2/1988 | Floyd | 36/136 |
| 4,766,682 | 8/1988 | Malloy, III | 36/132 |
| 4,978,304 | 12/1990 | Alexander | 36/136 |
| 4,991,318 | 2/1991 | Cornell | 36/72 R |

*Primary Examiner*—Steven N. Meyers

*Attorney, Agent, or Firm*—Morton J. Rosenberg; David I. Klein

[57] ABSTRACT

A wear protection device (10) is provided for protecting the instep portion (14) of a motorcycle boot (12) from wear which would otherwise result from contact with the gear shift lever of a motorcycle. Wear protection device (10) includes a flexible shield member (20) having a truncated elliptical contour and a releasable coupling (30) engaged within the arched portion (16) of the sole (18) of boot (12). In a preferred embodiment, the releasable coupling (30) includes a single strap member (31) threaded through a pair of slotted through openings (22, 24) disposed on oppposing ends (28) of shield member (20). Strap member (31) is formed of an elastic material having hook-and-loop fastening elements (36, 38) disposed on opposing ends (34, 32) of strap member (31), respectively.

7 Claims, 1 Drawing Sheet

MOTORCYCLE BOOT WEAR PROTECTION DEVICE

BACKGROUND OF THE INVENTION

1. Field of the Invention

This invention directs itself to protection devices for footwear. In particular, this invention directs itself to a device for protecting a motorcycle boot from excessive wear in the instep region thereof. Further, this invention directs itself to a wear protection device having a flexible shield member overlaying the instep region of the motorcycle boot. More in particular, this invention pertains to a wear protection device wherein the shield member is releasably coupled to the boot by means of an elastic strap member. Further, this invention directs itself to a wear protection device wherein opposing ends of the elastic strap member are releasably coupled by means of a hook-and-loop type fastening system.

2. Prior Art

Protection devices for footwear are well known in the art. The best prior art known to the Applicant include U.S. Pat. Nos. 4,766,682; 4,237,628; 2,851,798; 3,024,754; 3,561,142; 3,045,367; 3,812,606; 1,592,110; 2,836,908; 4,231,170; 4,665,633; and, 3,175,310.

Some prior art systems, such as that shown in U.S. Pat. No. 4,766,682 are directed to lace cover straps for use about the instep of a shoe. However, such systems require that the strap be maintained in position by means of hook-and-loop type fasteners, while additionally requiring an elastic band, coupled to the medial portion of the strap, for maintaining the position thereof.

In other prior art systems, such as that disclosed in U.S. Pat. No. 2,851,798, such prior art systems direct themselves to foot protective guards where an outer face of the guard extends above the instep and toe portion of the shoe. Such guards may include members of metal and spongy material which lie adjacent the instep portion of the shoe, and include a strap which passes around the shoe for fastening with a snap fastener. However, such devices fail to provide the simplicity of the structure for the instant invention, fail to provide the functionality of instant invention, and fail to provide an aesthetically pleasing addition to the associated footwear.

SUMMARY OF THE INVENTION

A wear protection device for a motorcycle boot is provided. The wear protection device includes a shield member formed of a flexible material releasably coupled to the motorcycle boot. The shield member overlays an intermediate portion of an upper surface of an instep portion of the motorcycle boot. The wear protection device further includes an assembly for elastically coupling the shield member to the motorcycle boot. The elastic coupling includes at least one strap member coupled to the shield member for releasably coupling the shield member to the motorcycle boot. The strap member being formed of an elastic material composition and having a pair of opposing ends. The wear protection device further includes an assembly for releasably coupling the opposing ends of the strap member.

DESCRIPTION OF THE PREFERRED EMBODIMENTS

Figure 1:
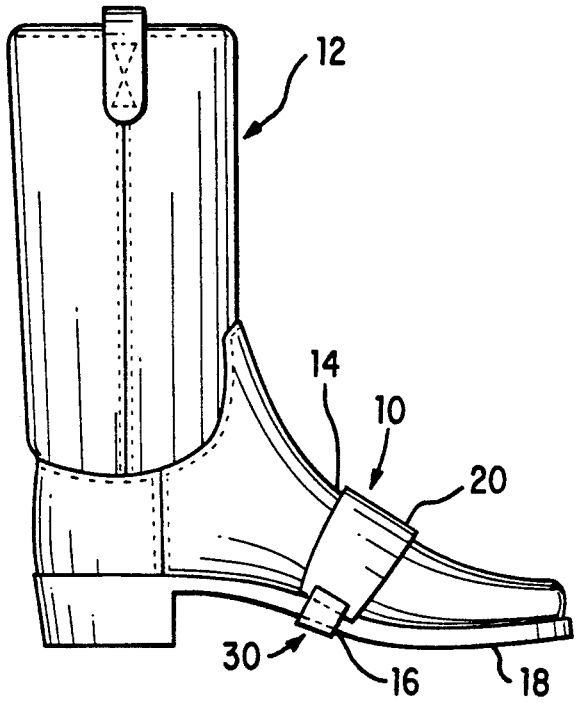
FIG. 1 is an elevation view of a motorcycle boot embodying the present invention.

Referring now to FIGS. 1–4, there is shown wear protection device 10 for releasable coupling with the motorcyle boot 12. As will be seen in following paragraphs, wear protection device 10 is specifically directed to the concept of providing an aesthetically pleasing attachment to a motorcycle boot 12 for protecting the instep portion 14 thereof. Although not restricted to utilization on motorcycle boots, wear protection device 10 is particularly adapted to protect the instep portion 14 of motorcycle boot 12 from excessive wear due to contact with the gear shift lever of a motorcycle. Additionally, wear protection device 10 is provided with indicia 40 disposed on an upper surface 26 for enhancing the visual attractiveness of the motorcycle boot to which the device 10 is coupled.

Referring now to FIG. 1, there is shown motorcycle boot 12 having wear protection device 10 coupled thereto. Wear protection device 10 includes a shield member 20 for overlaying a portion of the instep 14 of boot 12. Shield member 20 is maintained in overlaying relationship with instep 14 by means of an elastic coupling 30 which passes under the forward end of the arched portion 16 of the sole 18. It is particularly advantageous that the elastic coupling 30 be disposed in the arched portion 16 of sole 18, since in that location the coupling 30 will remain undisturbed when the boot is worn, as the coupling 30 will not make contact with the ground. Thus, when the user has finished riding his motorcycle there is no need to remove the wear protection device 10 from the boot 12, as such will remain properly positioned as the user continues to wear the boot while engaging in other activities, such as walking.

Figure 2:
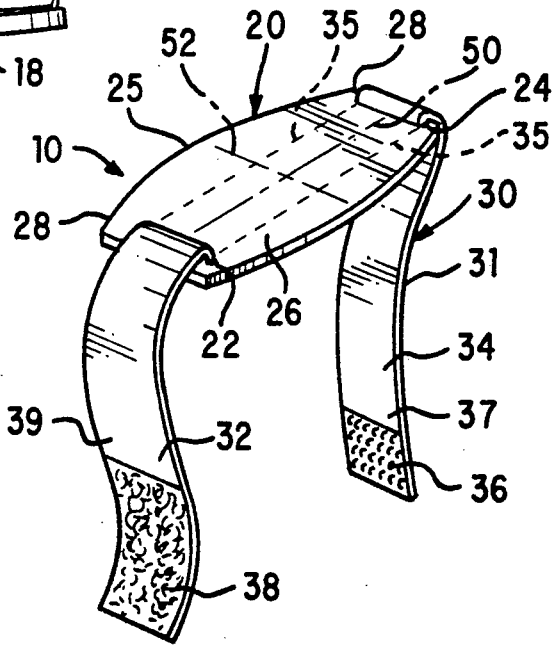
FIG. 2 is a perspective view of the present invention.

As shown in FIG. 2, wear protection device 10 includes a shield member 20 formed of a flexible material, such as leather, vinyl, or the like. Being flexible, allows the shield member 20 to conform to the contour of insole 14 of boot 12. Additionally, the flexibility of shield 20 insures that the shield member 20 does not scuff or otherwise mar the surface region which it is intended to protect. Thus, while shield members formed of such materials as metal might protect the boot from wear which would otherwise be induced by the motorcycle gear shift lever, such metal devices would, over time, damage the surface of insole portion 14. Thus, it is preferred that the shield member 20 be formed of a leather material to protect the boot 12 from the gear shift lever, without itself causing damage to the boot. Shield member 20 is formed with a truncated elliptical contour, having a maximum width in the central portion 25, in a direction defined by the minor axis 52 of the elliptical contour of shield 20. The major axis 50 of the elliptical contour is truncated at opposing ends 28, from which the releasable coupling elements extend.

It is of critical importance that shield member 20 be formed in a truncated elliptical contour. The truncated elliptical contour provides a central region 25 of maximum width, providing a maximized area for contact with the motorcycle gear shift lever, maximizing the protection for boot 12. However, maximum tightness with respect to the fit of shield 20 over the curved contour of the instep region 14 of boot 12 requires that the width of shield 20 where it is coupled to releasable coupling 30 be no more than 25% greater than the width of the strap member 31 of releasable coupling 30. Further, absent the opposed arcuate edge surfaces of shield 20, a member having a width equal to the minor diameter of shield 20 would buckle, or otherwise not conform to the boot contour. Thus, the particular truncated elliptical contour maximizes the protection of the instep 14 of boot 12, while permitting the releasable coupling 30 to be efficiently sized to provide the required holding force with the least amount of material.

Elastic coupling 30 may be formed by a signal elastic strap member having opposing ends 32 and 34. The strap 31 is threaded through a pair of slotted through openings 22 and 24 formed in shield member 20, adjacent the opposing ends 28. Strap 31 is threaded through holes 22 and 24 such that the central portion of the strap member extends between the slotted through openings 22, 24 on the underside of shield member 20, as indicated by the dashed lines 35. The distalmost end portions of the opposing ends of the elastic strap 31 are provided with cooperating elements of a releasable coupling system, such as Velcro. The underside 37 of the strap end 34 may be provided with a hook type fastening element 36 coupled thereto. In a similar manner, the upper surface 39 of the strap end portion 32 may be provided with a loop type coupling element 38. The loop type coupling element 38 is of sufficiently larger dimension than the hook type fastener 36 to allow for adjustment in the tension of the elastic strap.

The strap 31 of elastic coupling 30 is formed of an elastic material, which allows the shield member 20 to be placed in sufficient tension such that the shield member 20 conforms to the contour of the instep portion 14 of boot 12 and it maintains in contiguous contact therewith. In this way, the wear protection device 10 is adapted to fit a wide variety of different sized boots, providing adjustment by means of elongation of strap 31 and by the degree of overlap of end portion 34 with respect to end portion 32.

Figure 4:
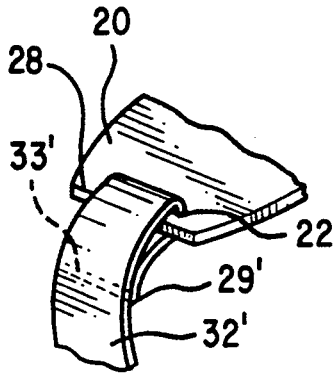
FIG. 4 is a detailed fragmentary view of the present invention.

Referring to FIG. 4, there is shown an alternate embodiment of releasable coupling 30 wherein a pair of strap 32', only one of which being in the drawing, are each coupled to an opposing end 28 of shield member 20. Each of the straps 32' is looped through a respective slotted through opening 22, 24 in the shield member 20 and fastened itself. The end 29' of strap 32' is fastened by means of stitching 33', or other fastening techniques known in the art.

Figure 3:
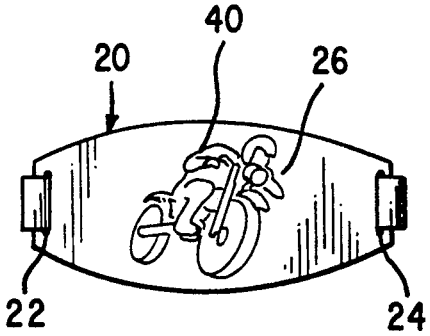
FIG. 3 is a plan view of the shield member of the present invention.

As shown in FIG. 3, the shield member 20 is provided with an upper surface 26 having indicia 40 formed thereon. Indicia 40 may be any one of a plurality of aesthetically pleasing designs for enhancing the appearance of motorcycle boot 12. The indicia 40 is best cut, or etched, into the upper surface 26 of shield member 20 so as to provide an aesthetically pleasing image which will endure the wearing action of the gear shift lever of a motorcycle which takes place over time. Thus, not only does the shield member 20 protect the instep portion 14 of boot 12 from wear, but provides the additional functionality of making the boot more aesthetically pleasing.

Wear protection device 10 is particularly adapted for overlaying an instep portion 14 of a motorcycle boot 12, wherein the strap 31 of releasable coupling 30 overlays the forwardmost portion of the arch portion of the sole 18 of boot 12. This arrangement prevents strap 31 from being disturbed or damaged from the wear and tear to which the portion of sole 18 contacting the ground is normally subjected. The length of shield member 20, the distance between the truncated ends 28 along the major axis 50, has been predetermined to permit strap 31 to be located in the arch portion 16, as previously described.

Strap 31 is formed of an elastic material to provide sufficient tension on shield member 20 to maintain shield 20 in contiguous overlaying relationship with the instep portion 14 of boot 12. Key to the functionality of wear protection device 10 and the simple method by which it is secured to boot 12, is the truncated elliptical contour of shield member 20. The opposed edges of shield member 20 extending in the direction of the major axis 50, have an arcuate contour with a maximum dimension therebetween occurring in the central portion 25, at the minor axis 52. This configuraton providing the advantage of maximizing the surface region protected, while providing a shape which is most easily contoured to match that of boot 12.

The strap 31, or in the alternative each of straps 32', are coupled to the shield member 20 at opposing truncated ends 28, whose width dimension is not more than 25% greater than the corresponding width to the strap member 31, 32'. By maintaining such a dimensional relationship, sufficient tension is transferred substantially uniformly across the whole of shield member 20, even at the central region 25.

Strap 31, or each of straps 32', are formed of an elastic material composition, and together with the Velcro type fastening elements 36, 38 provide an elastic coupling system 30 which is adaptable for securement to a wide range of boot sizes, permitting shield 20 to adequately protect a wide variety of boots. Of particular advantage, is the use of a single elastic strap 31 which is threaded through the respective slotted openings 22 and 24 such that each of the strap ends 32 and 34 pass from the underside of shield member 20 to the top surface 26, with a central portion extending between the openings 22 and 24 on the underside of shield member 20. The use of a single strap member 31 simplifies the structure of wear protection device 10, and provides a low cost method of attachment. The single strap 31 provides the additional advantage in that the shield member 20 may be adjustably displaced on strap 31 with respect to the ends 32 and 34, to suit the user. Thus, if the user tends to contact the gear shift lever of his motorcycle at a location displaced from the center of the instep 14, the shield member can be suitably adjusted to provide the necessary wear protection at the point of contact.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as claimed in the appended Claims.

What is claimed is:

1. An wear protection device for a motorcycle boot, comprising:

a shield member formed of a flexible material releasably coupled to said motorcycle boot, said shield member overlying an intermediate portion of an upper surface of an instep of said motorcycle boot, said instep extending toward a toe portion of said boot in a first direction, said shield member being formed in a truncated substantially elliptical contour having a minor axis extending substantially parallel said first direction, said elliptical contour being truncated on opposing ends of a major axis of said elliptical contour, whereby said shield member provides a maximum protective surface overlying a central frontal portion of said instep for contact with a motorcycle gearshift lever to thereby substantially prevent wear of said instep and a reduced width dimension proximate said truncated opposing ends, said shield member having a pair of slotted through openings formed therein, each of said slotted through openings being disposed adjacent a respective one of said truncated opposing ends;

means for elastically coupling said shield member to said motorcycle boot, said elastic coupling means including at least one strap member having a predetermined width dimension coupled to said shield member through said slotted through openings for releasably coupling said shield member to said motorcycle boot, said truncated opposing ends having a width dimension not more than 25% greater than said width dimension of said strap member for substantially maximizing the holding force of said strap member, said strap member being formed of an elastic material composition and having a pair of opposing ends; and, means for releasably coupling said opposing ends of said strap member.

2. The wear protection device as recited in claim 1 where said shield member is formed of a leather material composition.

3. The wear protection device as recited in claim 1 where said shield member includes an upper surface portion with indicia formed thereon for providing an aesthetically pleasing appearance to said motorcycle boot.

4. The wear protection device as recited in claim 1 where said releasable coupling means includes (1) a hook-type fastening element coupled to one end of said strap member, and (2) a loop-type fastening element coupled to an opposing end of said strap member.

5. The wear protection device as recited in claim 1 where said elastic coupling means includes a pair of strap members extending from said opposing ends of said shield member in a second direction, said second direction being substantially orthogonal said first direction.

6. The wear protection device as recited in claim 5 where each of said pair of strap members includes a first end fixedly coupled to a respective end of said shield member through said respective slotted opening.

7. The wear protection device as recited in claim 6 where said releasable coupling means includes (1) a hook-type fastening element coupled to a second end of one of said pair of strap members, and (2) a loop-type fastening element coupled to a second end of said other of strap members.

* * * * *